US007150208B2

(12) United States Patent
Debley

(10) Patent No.: US 7,150,208 B2
(45) Date of Patent: Dec. 19, 2006

(54) UNIVERSAL STEPLESS WRENCH

(76) Inventor: Bill Debley, 7424 Strathern St., Northridge, CA (US) 91325

( * ) Notice: Subject to any disclaimer, the term of this patent is extended or adjusted under 35 U.S.C. 154(b) by 55 days.

(21) Appl. No.: 10/991,104

(22) Filed: Nov. 17, 2004

(65) Prior Publication Data

US 2005/0103164 A1 May 19, 2005

Related U.S. Application Data

(60) Provisional application No. 60/523,055, filed on Nov. 17, 2003.

(51) Int. Cl.
*B25B 13/46* (2006.01)

(52) U.S. Cl. ..... 81/59.1; 81/177.2

(58) Field of Classification Search ..... 81/59.1, 81/58, 124.3, 124.5, 177.2
See application file for complete search history.

(56) References Cited

U.S. PATENT DOCUMENTS 835,448 A * 11/1906 Lowry et al. ..... 81/59.1
1,200,430 A * 10/1916 Rosenstein ..... 81/59.1
1,412,688 A * 4/1922 Layton et al. ..... 192/45
3,204,496 A * 9/1965 Ingram ..... 81/59.1
3,575,069 A * 4/1971 White ..... 81/58.1
3,838,614 A * 10/1974 O'Donnell ..... 81/60
3,868,983 A * 3/1975 Newcomb ..... 81/59.1
4,054,067 A * 10/1977 Blank ..... 81/58.1
4,485,699 A * 12/1984 Fuller ..... 81/59.1
4,603,606 A * 8/1986 Headen ..... 81/59.1
5,499,559 A * 3/1996 Lin ..... 81/59.1
5,509,332 A * 4/1996 Donaldson, Jr. ..... 81/59.1
5,651,294 A * 7/1997 Shiao ..... 81/59.1
6,089,133 A * 7/2000 Liao ..... 81/438
6,112,624 A * 9/2000 Chen ..... 81/59.1
6,202,512 B1 * 3/2001 O'Brien et al. ..... 81/59.1
6,253,646 B1 * 7/2001 Chang ..... 81/59.1

* cited by examiner

*Primary Examiner*—David B. Thomas

(57) ABSTRACT

The present invention relates to a universal stepless wrench. More particularly, it relates to a wrench with a stepless rotatable for receiving and turning a slideable shaft in a desired direction. The rotatable allows a tool handle to rotate freely around the slideable shaft in one direction, but to engage with and lock against the slideable shaft when turned in an opposite direction. When the tool handle is moved in a locked direction, the slideable shaft is rotated, thereby rotating a socket or other suitable object.

30 Claims, 12 Drawing Sheets

UNIVERSAL STEPLESS WRENCH

PRIORITY CLAIM

This application is a non-provisional application, claiming the benefit of priority to provisional application No. 60/523,055, filed in the United States on Nov. 17, 2003, and titled "Universal Stepless Wrench".

BACKGROUND (1) Field of Invention

The present invention relates to a wrench, and more particularly, to a wrench with a stepless mechanism for receiving and turning a slideable shaft in a desired direction.

(2) Description of Related Art

Wrench mechanisms have generally included a spring and pawl arrangement where the spring-biased pawl engages teeth of a driven gear. The pawl is arranged such that it is cammed away from the gear teeth upon rotation in one direction, but forced to engage with the gear when turned in the other direction.

While the spring and pawl arrangement is effective, it suffers from several inherent problems. For example, because of its ratcheting mechanism, there is considerable drag and friction between moving parts such as the pawl and gear. The friction can result in gear wear or breakage. Additionally, there is a significant amount of opposite or backward rotation before the pawl wedges into the gear teeth to immobilize the gear. While the backward rotation may only be a few degrees, this may be objectionable in certain applications.

A stepless wrench largely overcomes these problems. U.S. Pat. No. 1,412,688, issued to Layton and Hopkins, teaches using a wrench with friction gripping rollers. When in use, the friction gripping rollers allow the wrench to freely rotate around a shaft in one direction, but bind on the shaft when turned in the other direction. Although such stepless wrenches previously devised solve several of the problems inherent in the spring and pawl arrangement, they also suffer from several problems. While a shaft may be easily inserted into the stepless wrench, there is little to keep it from sliding out. Additionally, the previous stepless wrenches only accept the shaft perpendicularly to the handle, precluding a user from fitting the wrench into tight spaces by accepting the shaft parallel with the handle.

In light of the shortcomings of current wrenches discussed above, it can be appreciated that there exists a continuing need for a new and improved stepless wrench, where an inserted shaft stays affixed with the wrench and where the handle can also be manufactured to operate parallel to the inserted shaft. In this regard, the present invention substantially fulfills this need.

SUMMARY OF INVENTION

The present invention relates to a wrench, and more particularly, to a universal stepless wrench with a stepless mechanism for receiving and turning a slideable shaft in a desired direction. The universal stepless wrench comprises a tool handle having a rotatable receiving-portion. A first rotatable is encased in the rotatable receiving-portion of the tool handle, allowing the tool handle to rotate freely around an inserted slideable shaft in one direction, but to engage with and lock against the inserted slideable shaft when turned in an opposite direction. Additionally, a slideable shaft can be inserted into the first rotatable, whereby when the slideable shaft is inserted, the first rotatable allows the tool handle to freely rotate around the slideable shaft in one direction, but to engage with and lock against the slideable shaft when turned in the opposite direction, thereby rotating the slideable shaft.

Additionally, the universal stepless wrench further comprises an annular annular elastic cap having a central opening and covering a lip portion of the first rotatable, where the slideable shaft is inserted through the annular elastic cap and into the first rotatable.

In another aspect, the slideable shaft is a removable shaft.

In yet another aspect, the first rotatable comprises a hollow cylinder with a plurality of recesses spaced around a circumference of the hollow cylinder. Rotary elements are included in each recess in the plurality of recesses. Furthermore, a bearing wall encases both the hollow cylinder and the rotary elements.

In another aspect, the plurality of recesses are wedge-shaped recesses.

Furthermore, the rotary elements are drawn-cup needle roller clutch bearings.

Additionally, the universal stepless wrench further comprises an axial protector on at least one end of the first rotatable, thereby helping with an axial load. The axial protector is selected from a group consisting of bushings and bearings.

In another aspect, the slideable shaft includes at least one notch. The at least one notch runs around a circumference, perpendicularly to a length of the slideable shaft. When the slideable shaft is inserted through the annular elastic cap, the annular elastic cap engages with the notch in order to adjustably hold the slideable shaft in place.

In yet another aspect, the slideable shaft has both a socket-receiving end and a bit-receiving end.

Furthermore, the tool handle operates perpendicularly to an inserted slideable shaft.

In another aspect, the tool handle operates parallel to an inserted slideable shaft.

In another aspect, the universal stepless wrench further comprises a second rotatable encased in the rotatable receiving-portion of the tool handle, where the second rotatable is positioned opposite the first rotatable such that the first rotatable allows for rotation in a first direction, while the second rotatable allows for rotation in a second direction.

Additionally, the slideable shaft further comprises a raised section, where the raised section is engageable with at least one of the first and second rotatables.

In yet another aspect, each of the first rotatable and the second rotatable comprise a hollow cylinder with a plurality of recesses spaced around a circumference of the hollow cylinder. Rotary elements are included in each recess in the plurality of recesses and a bearing wall encases both the hollow cylinder and the rotary elements.

Additionally, the plurality of recesses are wedge-shaped recesses and the rotary elements are drawn-cup needle roller clutch bearings.

In another aspect, the universal stepless wrench further comprises an axial protector on at least one end of the first rotatable and the second rotatable, thereby helping with an axial load. The axial protector is selected from a group consisting of bushings and bearings.

Finally, as can be appreciated by one in the art, the present invention is not limited to the apparatus described herein, but also includes a method for forming and using the same.

BRIEF DESCRIPTION OF THE DRAWINGS

The nature of the universal stepless wrench described herein will be readily apparent from the description below, taken in conjunction with the following drawings, in which.

DETAILED DESCRIPTION

The present invention relates to a wrench, and more particularly, to a wrench with a stepless mechanism for receiving and turning a notched shaft in a desired direction.

The following description, taken in conjunction with the referenced drawings, is presented to enable one of ordinary skill in the art to make and use the invention. Various modifications will be readily apparent to those skilled in the art, and the general principles defined herein may be applied to a wide range of aspects. Thus, the present invention is not intended to be limited to the aspects presented, but is to be accorded the widest scope consistent with the principles and novel features disclosed herein. Furthermore it should be noted that unless explicitly stated otherwise, the figures included herein are illustrated diagrammatically and without any specific scale, as they are provided as qualitative illustrations of the concept of the present invention.

Figure 1:
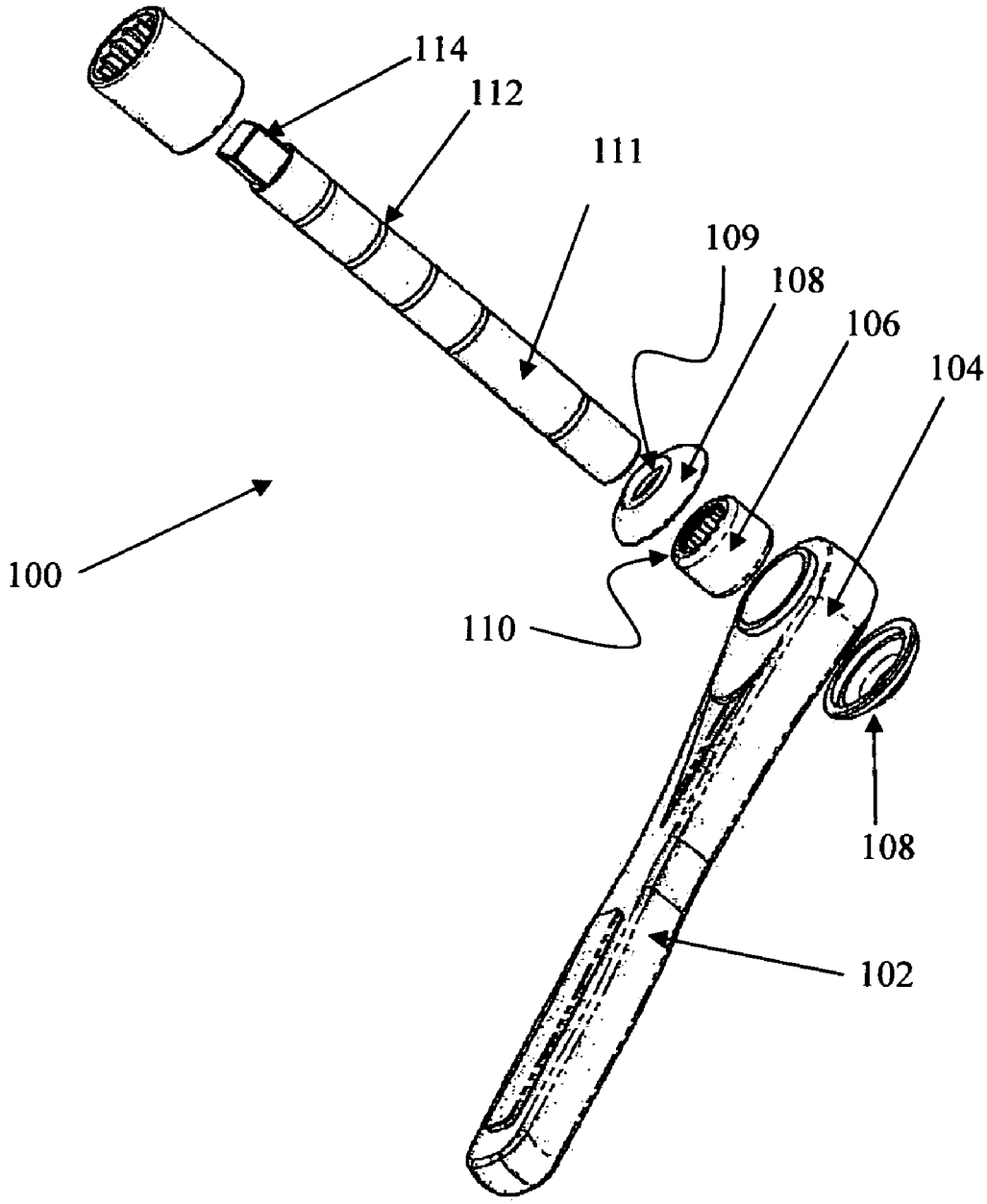
FIG. 1 is a blown-up side perspective view of a universal stepless wrench according to the present invention.

FIG. 1 illustrates a universal stepless wrench 100 according to the present invention. The universal stepless wrench 100 comprises a tool handle 102. The tool handle 102 includes a rotatable receiving-portion 104 with a first rotatable 106 encased in the rotatable receiving-portion 104. The tool handle 102 and first rotatable 106 may be constructed of any suitable material, non-limiting examples of which include plastic and metal, such as a forged metal alloy.

Additionally, an annular elastic cap 108 having a central opening 109 is attached with the universal stepless wrench 100 such that the annular elastic cap 108 covers a lip portion 110 of the first rotatable 106. The annular elastic cap 108 may be constructed of any suitably elastic material, a non-limiting example of which includes rubber. A slideable shaft 111 may be inserted through the central opening 109 in the annular elastic cap 108 and into the first rotatable 106. The slideable shaft 111 may be constructed of any suitably durable material, a non-limiting example of which includes metal. The slideable shaft 111 slides in a direction to be moved through the first rotatable 106. For example, it may be removed from the first rotatable 106 altogether. The slideable shaft 111 may include at least one notch 112. The notch 112 may be any suitable size or shape to engage the annular elastic cap 108. For example, the notch 112 may run around a circumference and perpendicularly to of a length of the slideable shaft 111. When the slideable shaft 111 is inserted through the annular elastic cap 108, the annular elastic cap 108 engages with the notch 112 in order to adjustably hold the slideable shaft 111 in place.

The slideable shaft 111 has an end portion 114 that may include a fitting. The fitting may be any suitable size or shape to be engaged with another object, non-limiting examples of which include a square socket fitting, a Phillips fitting, and a hex fitting.

The tool handle 102 may be positioned in any suitable way to operate an inserted slideable shaft 111. For example, the tool handle 102 may be positioned such that it operates parallel to an inserted slideable shaft 111. Alternatively, and as shown in the particular view presented in FIG. 1, the tool handle 102 may be positioned such that it operates perpendicularly to an inserted slideable shaft 111.

Figure 2:
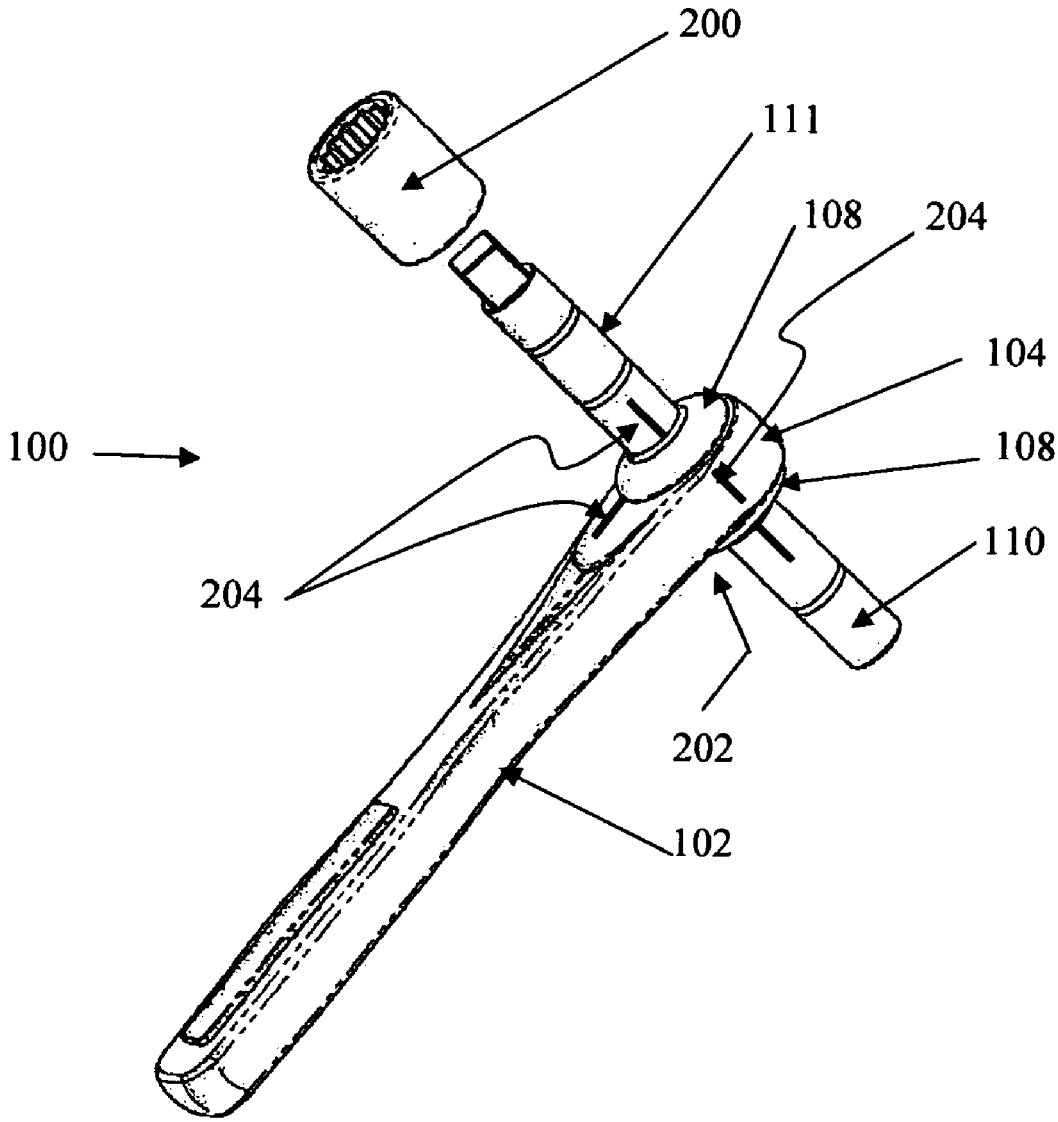
FIG. 2 is a side perspective view of a notched shaft is inserted through a universal stepless wrench.

FIG. 2 illustrates the universal stepless wrench 100 of FIG. 1, with the slideable shaft 111 inserted through both the annular elastic cap 108 and the first rotatable 106. In this illustration, the first rotatable 106 is not visible because it is encased in the rotatable-receiving portion 104 of the tool handle 102. Furthermore, the tool handle 102 is positioned such that it operates perpendicularly to the inserted slideable shaft 111. Once the slideable shaft 111 is inserted, the tool handle 102 may be connected with a socket 202 and thereafter with an item such as a bolt. The tool handle 102 may be operated in a manner to turn the item. The first rotatable allows the tool handle 102 to rotate freely around the slideable shaft 111 in one direction, but to engage with and lock against the slideable shaft 111 when turned in an opposite direction. When the tool handle 102 is moved in a locked direction, the slideable shaft 111 is rotated, thereby rotating a socket 202 or other suitable object.

In order to rotate the slideable shaft 111 in an opposite direction, the tool handle 102 may be removed from the slideable shaft 111 and simply turned over. Once the slideable shaft 111 is re-inserted into the tool handle 102 from an opposite side 202, the tool handle 102 can then be turned to rotate the slideable shaft 111 in the opposite direction.

Additionally, both the slideable shaft 111 and the tool handle 102 include angle markings 204. The angle markings 204 allow a user to determine to what degree or angle the slideable shaft 111 has been turned. The angle markings 204 may located at any suitable location to allow a user to compare the angle markings 204 on the slideable shaft 111 with the angle markings 204 on the tool handle 102, non-limiting examples of which include being along the sides of the slideable shaft 111 and along the top and sides of the tool handle 102. For example, the slideable shaft 111 may simply have a line marked thereon, that can be compared to a plurality of markings on the tool handle 102, where the markings on the tool handle include an angle degree corresponding to each marking.

Figure 3:
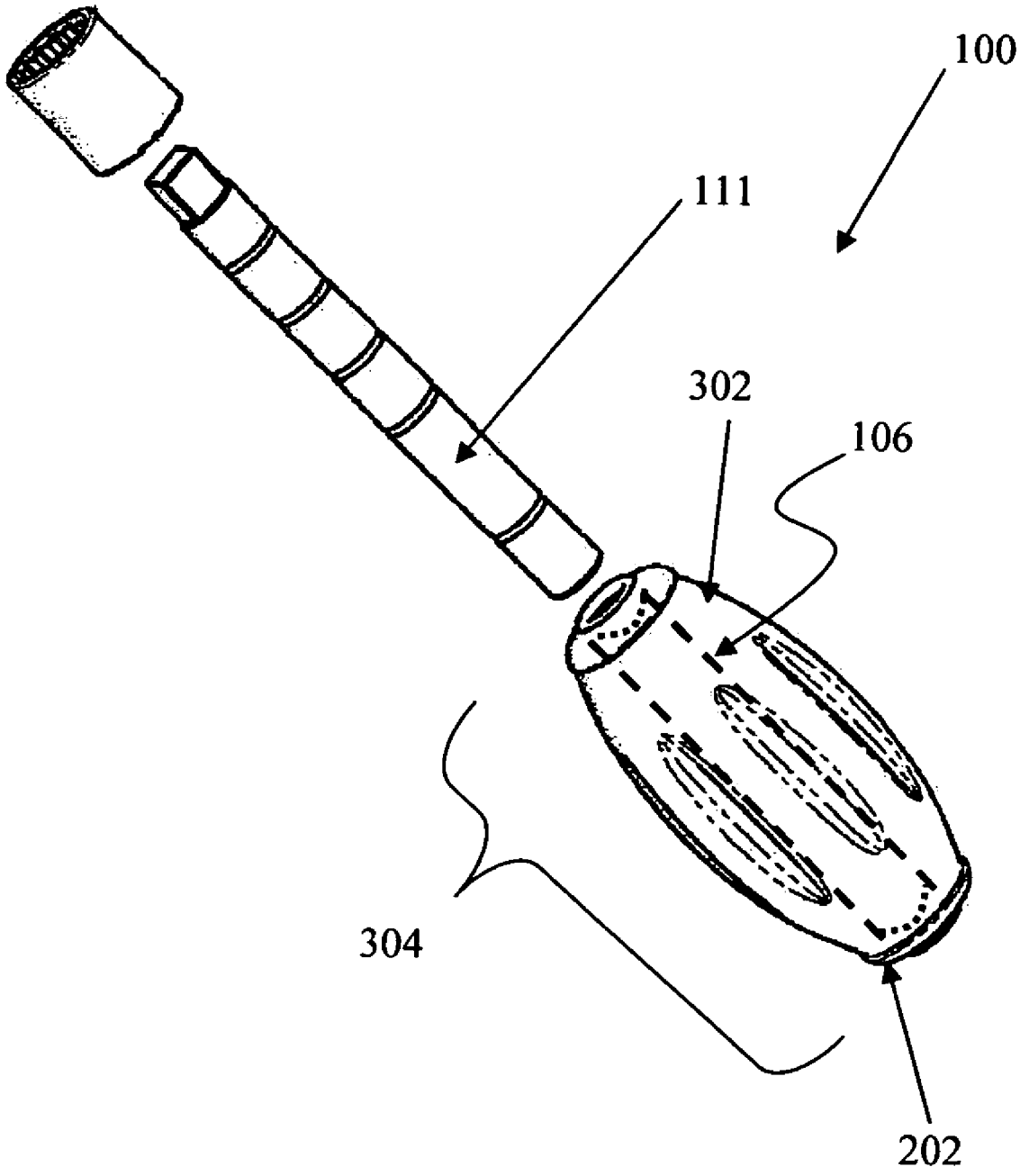
FIG. 3 is a side perspective view of a handle of the wrench, where the handle runs parallel with the notched shaft.

FIG. 3 illustrates another aspect of the present invention, where the tool handle 302 runs parallel with the slideable shaft 111. In this aspect, the rotatable receiving-portion 304 runs the length of the tool handle 302. Encased in the rotatable receiving-portion 304 is the first rotatable 106. The first rotatable 106 may be a single first rotatable 106 or a plurality of rotatables. The tool handle 302 and its rotatable receiving-portion 304 may be constructed of any suitably durable material, non-limiting examples of which include plastic and metal. An advantage to this particular configuration is that it allows a user to operate the universal stepless wrench 100 in a manner similar to that of a screwdriver. In this aspect, the universal stepless wrench 100 would be beneficial in constricted spaces, allowing the tool handle 302 to rotate freely around the slideable shaft in one direction, but to engage with and rotate the slideable shaft 111 when turned in an opposite direction.

As is the case with the previous aspect, the slideable shaft 111 can be removed from the tool handle 302. Once removed and re-inserted in the opposite side 202 of the tool handle 302, the slideable shaft 111 can be turned in another direction.

Figure 4:
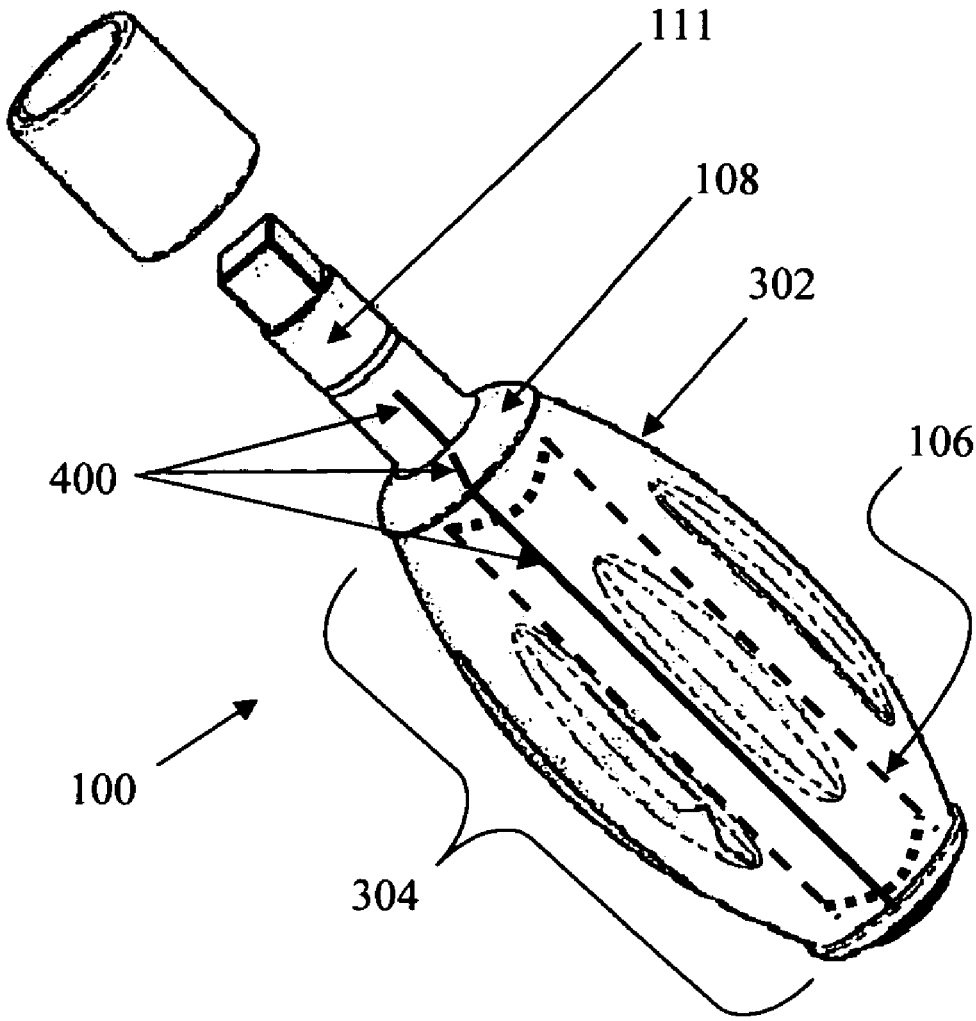
FIG. 4 is a side perspective view of a notched shaft inserted into the universal stepless wrench of FIG. 3.

FIG. 4 illustrates the universal stepless wrench 100 of FIG. 3, with the slideable shaft 111 inserted through both the annular elastic cap 108 and the first rotatable 106. In this illustration, the first rotatable 106 is not visible because it is encased in the rotatable receiving-portion 304 of the tool handle 302. As illustrated, the tool handle 302 is positioned such that it operates parallel to the inserted slideable shaft 111.

Additionally, both the slideable shaft 111 and the tool handle 302 include angle markings 400. The angle markings 400 allow a user to determine to what degree or angle the slideable shaft 111 has been turned. The angle markings 400 may located at any suitable location to allow a user to compare the angle markings 400 on the slideable shaft 111 with the angle markings 400 on the tool handle 302, non-limiting examples of which include being along the sides of the slideable shaft 111 and along the top and sides of the tool handle 302. For example, the slideable shaft 111 may simply have a line marked thereon, that can be compared to a plurality of markings on the tool handle 302, where the markings on the tool handle include an angle degree corresponding to each marking.

Figure 5A:
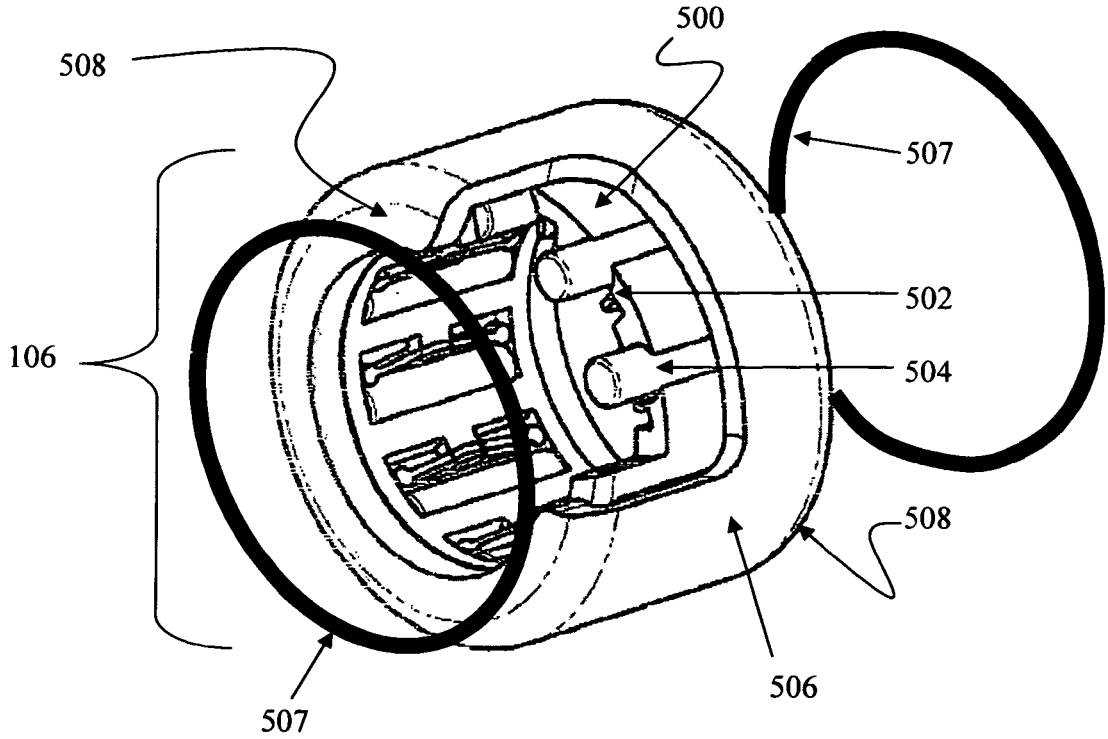
FIG. 5A is side perspective view of a first rotatable with a bearing wall of the first rotatable cut-away to shown an inner carrier and needle roller clutch bearings.

FIG. 5A illustrates a rotatable 106. The rotatable 106 may be any suitable stepless mechanism or device for aiding in the rotation of one object in relation to another object, a non-limiting example of which includes a drawn-cup needle roller clutch bearing. Furthermore, the rotatable 106 may comprise a hollow cylinder 500 with a plurality of recesses 502 spaced around a circumference of the hollow cylinder 500. Rotary elements 504 are included in the plurality of recesses. The rotary elements 504 may be any suitable element reducing friction between two points, a non-limiting example of which includes needle bearings, such as those used in needle roller clutch bearings. The plurality of recesses 502 may be wedge or drawn-cup shaped such that the rotary elements 504 allow free movement in one direction and prevent movement in an opposite direction.

Engaging with the hollow cylinder 500 is a bearing wall 506. The bearing wall 506 is pressed into the rotatable receiving-portion of the tool handle. The bearing wall 506 may be an integral part of the first rotatable 106, or alternatively, the first rotatable 106 may not have a bearing wall 506, where the bearing wall 506 is incorporated into the first rotatable receiving portion.

Additionally, an axial protector 507 may be added to at least one end 508 of the first rotatable 106, thereby helping with the axial load and extending the functional life of the first rotatable 106. The axial protector 507 may be any suitable mechanism or device for helping alleviate pressures of an axial load, non-limiting examples of which include bushings and bearings.

Figure 5B:
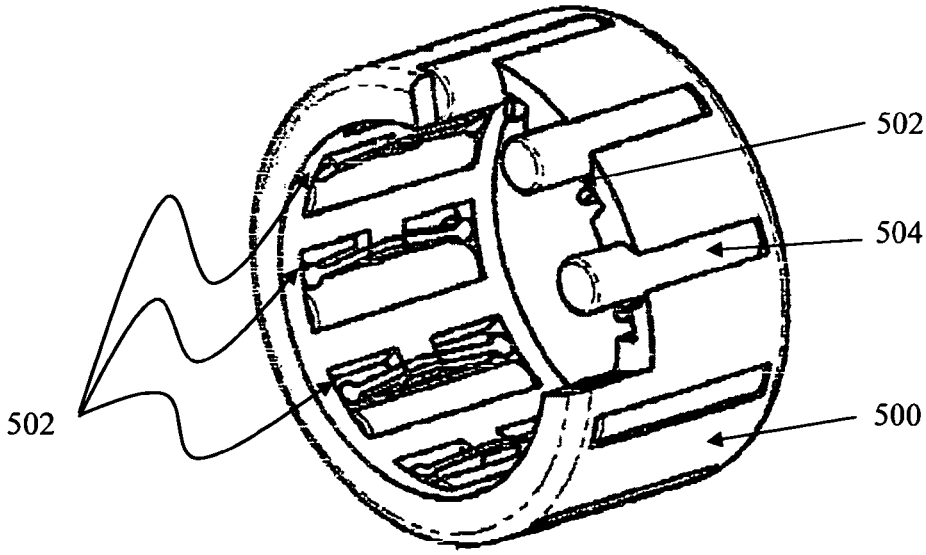
FIG. 5B is a side perspective view of an inner carrier partially cut-away.

FIG. 5B illustrates the hollow cylinder 500 with a plurality of recesses 502 spaced around a circumference of the hollow cylinder 500. As illustrated, the rotary elements 504 are contained within the plurality of recesses 502 in the hollow cylinder 500.

Figure 6A:
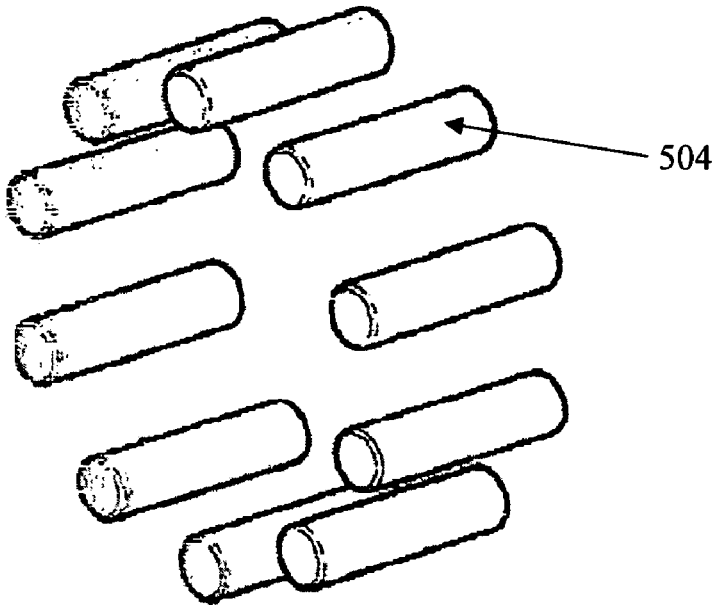
FIG. 6A is a side perspective view of needle roller clutch bearings.

FIG. 6A illustrates the rotary elements 504. The rotary elements 504 may be any suitable elements for reducing friction between two points, a non-limiting example of which includes needle roller clutch bearings.

Figure 6B:
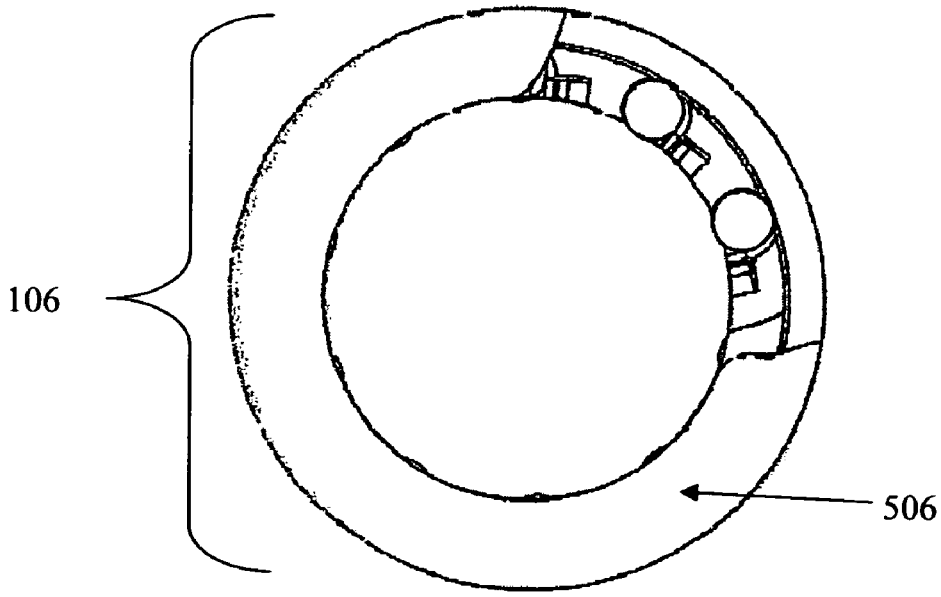
FIG. 6B is a top perspective view of the first rotatable with a portion of the bearing wall cut-away.

FIG. 6B illustrates a top-perspective view of the first rotatable 106, with a portion of the bearing wall 506 cut-away.

Figures 7A, 7B:
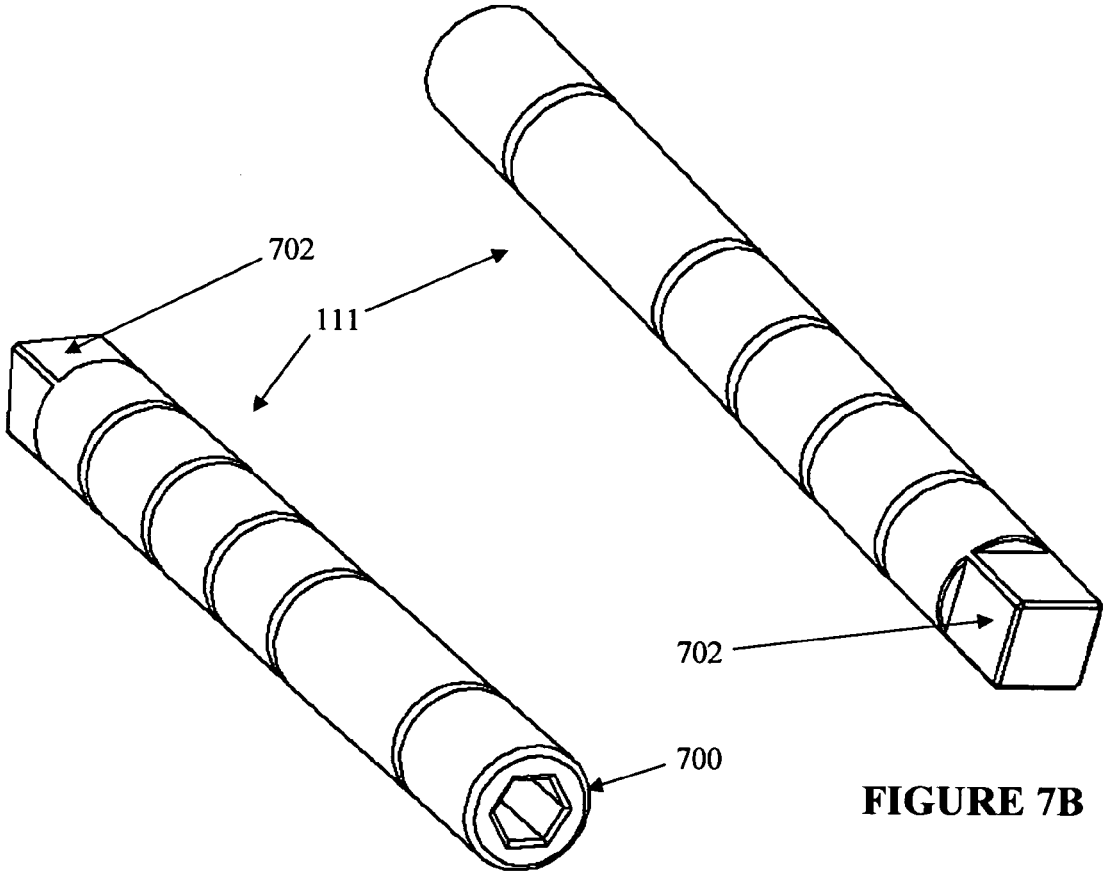
FIG. 7A is a side perspective view of a notched shaft with a bit-receiving end.
FIG. 7B is a side perspective view of a notched shaft with a socket-receiving end.

FIG. 7A is illustrates a side perspective view of a slideable shaft 111. In this aspect, the slideable shaft 111 has both a bit-receiving end 700 and a socket-receiving end 702. The bit-receiving end 700 is configured to receive any suitable tool bit, a non-limiting example of which includes a hexagonally shaped screwdriver bit.

FIG. 7B is a side perspective view of the slideable shaft 111 with a socket-receiving end 702. In this aspect, the socket-receiving end 702 may receive any suitable tool socket.

Figure 8:
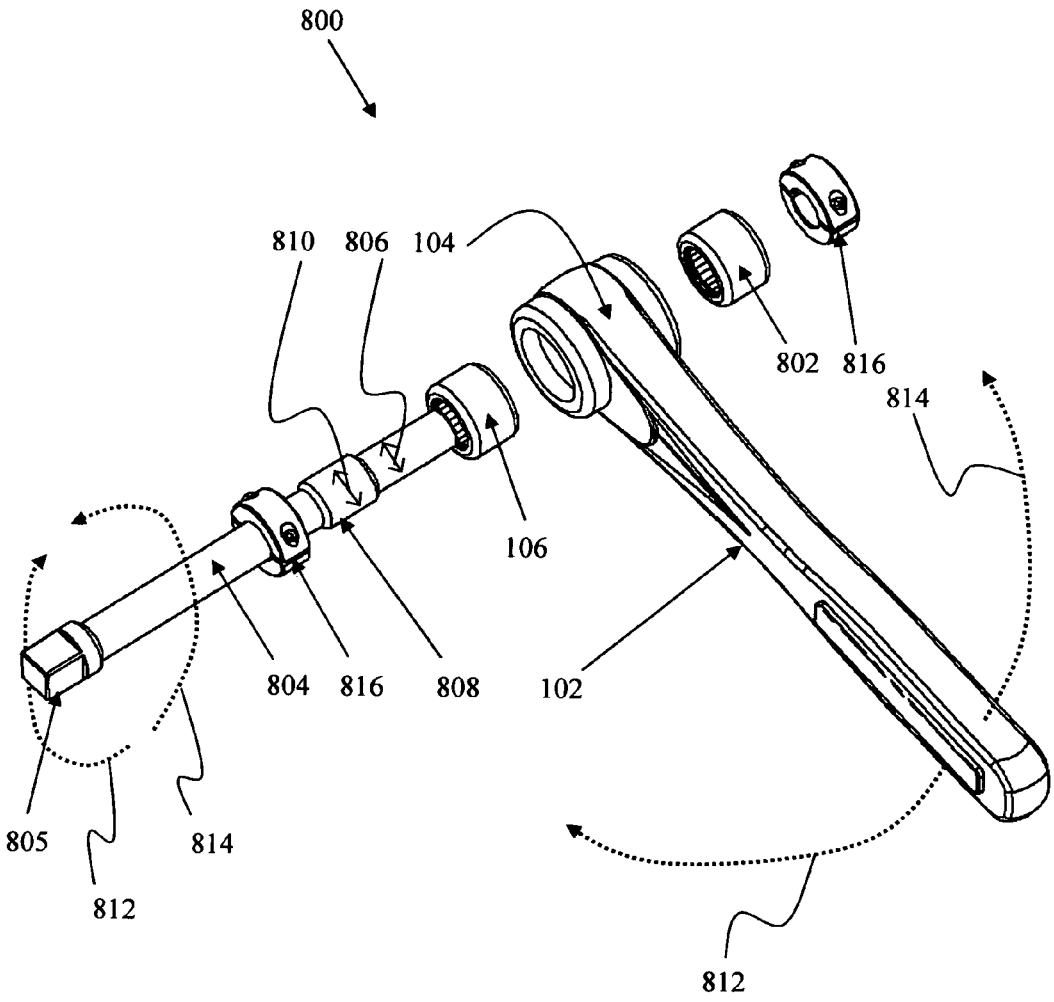
FIG. 8 is a blown-up side perspective view of a universal stepless wrench according to the present invention, with two rotatables encased in the rotatable receiving-portion, and with a shaft with a raised section inserted therein, where the raised section engages with at least one of the first and second rotatables.

FIG. 8 illustrates a blown-up view of another aspect of the universal stepless wrench 800 according to the present invention. In this aspect, the universal stepless wrench 800 comprises a tool handle 102. The tool handle 102 includes a rotatable receiving-portion 104, with both a first rotatable 106 and a second rotatable 802 encased in the rotatable receiving-portion 104. The second rotatable 802 may be the same rotatable mechanism as the first rotatable 106. For example, the second rotatable 802 may be any suitable stepless mechanism or device for aiding in the rotation of one object in relation to another object, a non-limiting example of which includes a drawn-cup needle roller clutch bearing. The second rotatable 802 is positioned opposite the first rotatable 106, such that an object engaged with the second rotatable 802 may freely turn in an opposite direction with respect to an object engaged with the first rotatable 106.

Inserted through both the first rotatable 106 and the second rotatable 802 is a slideable shaft 804. The slideable shaft 804 may be constructed of any suitably durable material, a non-limiting example of which includes metal. Additionally, the slideable shaft 804 has an end portion 805 that may include a fitting. The fitting may be any suitable size or shape to be engaged with another object, non-limiting examples of which include a square socket fitting, a Phillips fitting, and a hex fitting.

In this aspect, the slideable shaft 804 has a shaft diameter 806 and further includes a raised section 808 with a raised section diameter 810, where the raised section diameter 810 is greater than the shaft diameter 806. The raised section diameter 810 is such that the raised section 808 may engage with the rotatables.

When the raised section 808 is engaged with only the first rotatable 106, the tool handle 102 may rotate freely around the slideable shaft 804 in a first direction 812, but engage with and lock against the slideable shaft 804 when turned in a second direction 814. When the tool handle 102 is moved in a locked second direction 814, the slideable shaft 804 is rotated in a second direction 814, thereby rotating a socket or other suitable object.

When the raised section 808 is engaged with only the second rotatable 802, the tool handle 102 may rotate freely around the slideable shaft 804 in a second direction 814, but engage with and lock against the slideable shaft 804 when turned in a first direction 812. When the tool handle 102 is moved in a locked first direction 812, the slideable shaft 804 is rotated in a first direction 812, thereby rotating a socket or other suitable object.

When the raised section 808 is engaged with both the first rotatable 106 and the second rotatable 802, the tool handle 102 may not rotate freely around the slideable shaft 804 in either the first direction 812 or the second direction 814, but rather engages with and locks against the slideable shaft 804 when turned in either direction. When the raised section 808 is engaged with both rotatables, the tool handle 102 may be moved to rotate the slideable shaft 804 in either direction, thereby rotating a socket or other suitable object.

In order to ensure that the slideable shaft 804 remains inserted through both rotatables, a pair of shaft fasteners 816 are attached with the slideable shaft 804. The shaft fasteners 816 may be any suitable mechanisms or devices for fastening one object with another. The shaft fasteners 816 are attached with the slideable shaft 804 such that one is attached on each side of the shaft-receiving portion 104. Furthermore, the shaft fasteners 816 are attached at a position along the slideable shaft 804 to allow movement of the slideable shaft 804. The movement is such that the raised section 808 can be slid between being engaged with the first rotatable 106 to being engaged with the second rotatable 802.

Figure 9A:
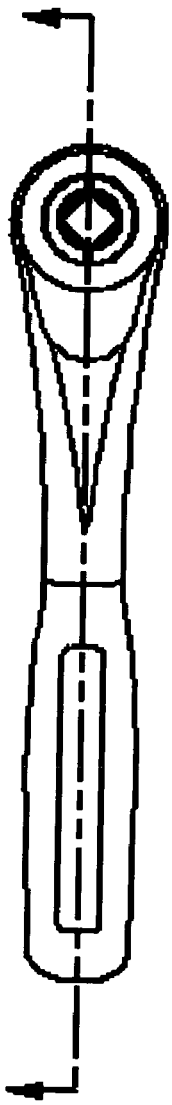
FIG. 9A is a front perspective view of the universal stepless wrench of FIG. 8, where the raised section of the shaft is engaged with a first rotatable.
Figure 9B:
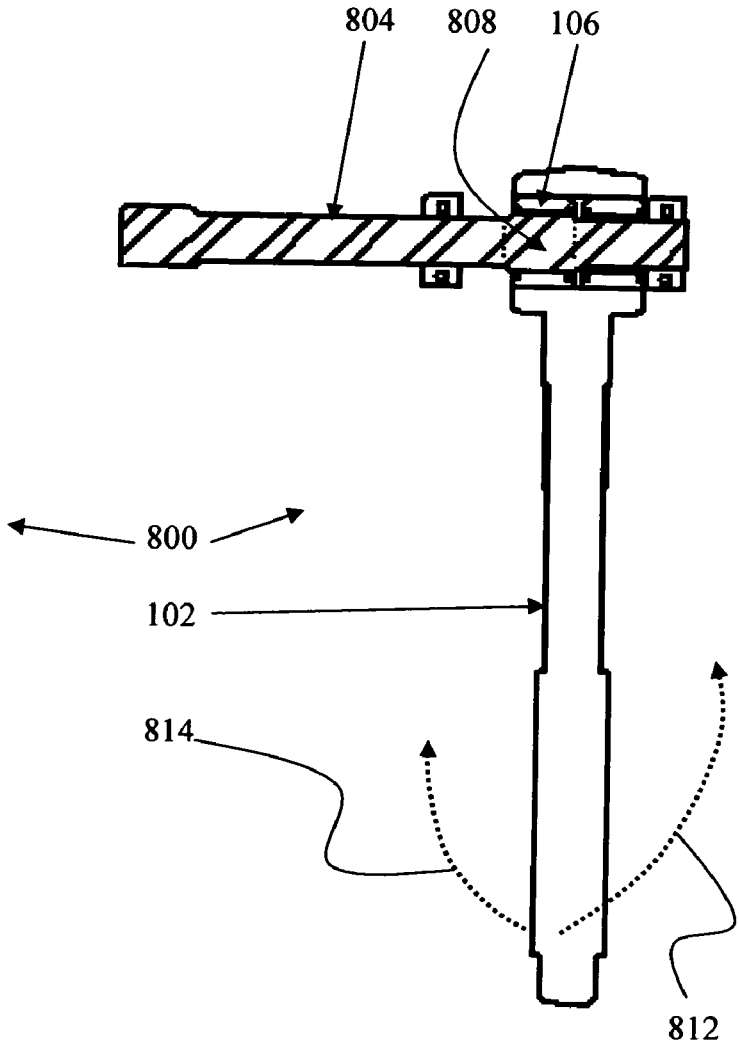
FIG. 9B is a cross-sectional view of a universal stepless wrench according to the present invention, taken from line IX—IX of FIG. 9A.

FIG. 9A illustrates a front perspective view of the universal stepless wrench 800 of FIG. 8. As illustrated in FIG. 9B, the raised section 808 of the slideable shaft 804 is engaged with only the first rotatable 106. In this position, the tool handle 102 may rotate freely around the slideable shaft 804 in a first direction 812, but engage with and lock against the slideable shaft 804 when turned in a second direction 814.

Figure 10A:
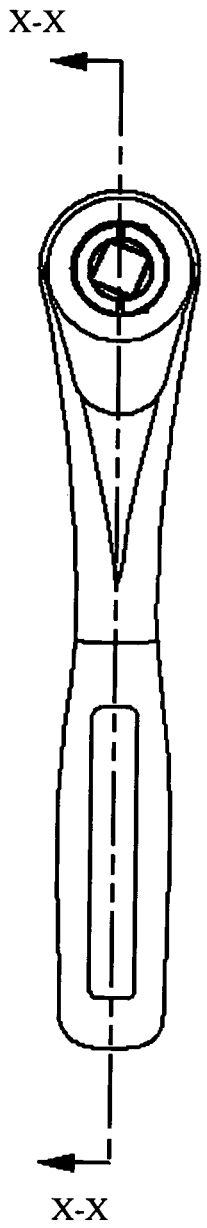
FIG. 10A is a front perspective view of the universal stepless wrench of FIG. 8, where the raised section of the shaft is engaged with a second rotatable.
Figure 10B:
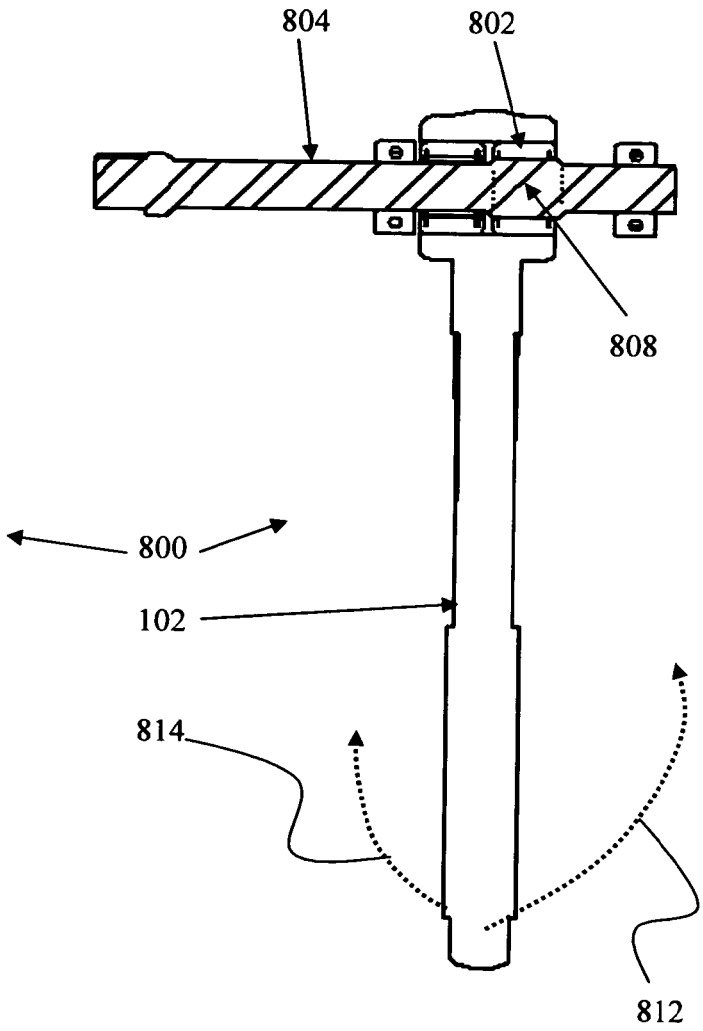
FIG. 10B is a cross-sectional view of a universal stepless wrench according to the present invention, taken from line X—X of FIG. 10A.

FIG. 10A illustrates a front perspective view of the universal stepless wrench 800 of FIG. 8. As illustrated in FIG. 10B, the raised section 808 of the slidebable shaft 804 is engaged with only the second rotatable 802. In this position, the tool handle 102 may rotate freely around the slideable shaft 804 in a second direction 814, but engage with and lock against the slideable shaft 804 when turned in a first direction 812.

Figure 11A:
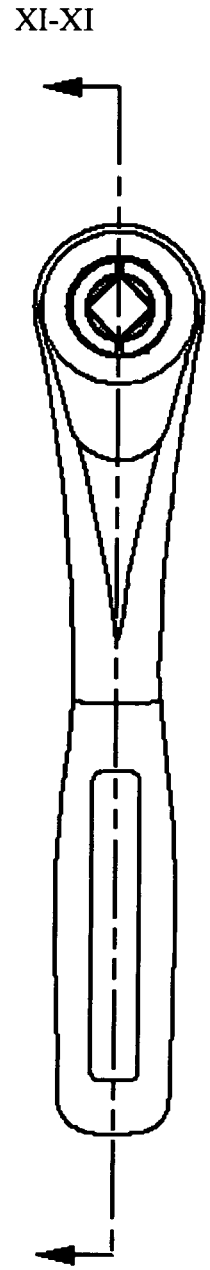
FIG. 11A is a front perspective view of the universal stepless wrench of FIG. 8, where the raised section of the shaft is engaged with both the first rotatable and the second rotatable.
Figure 11B:
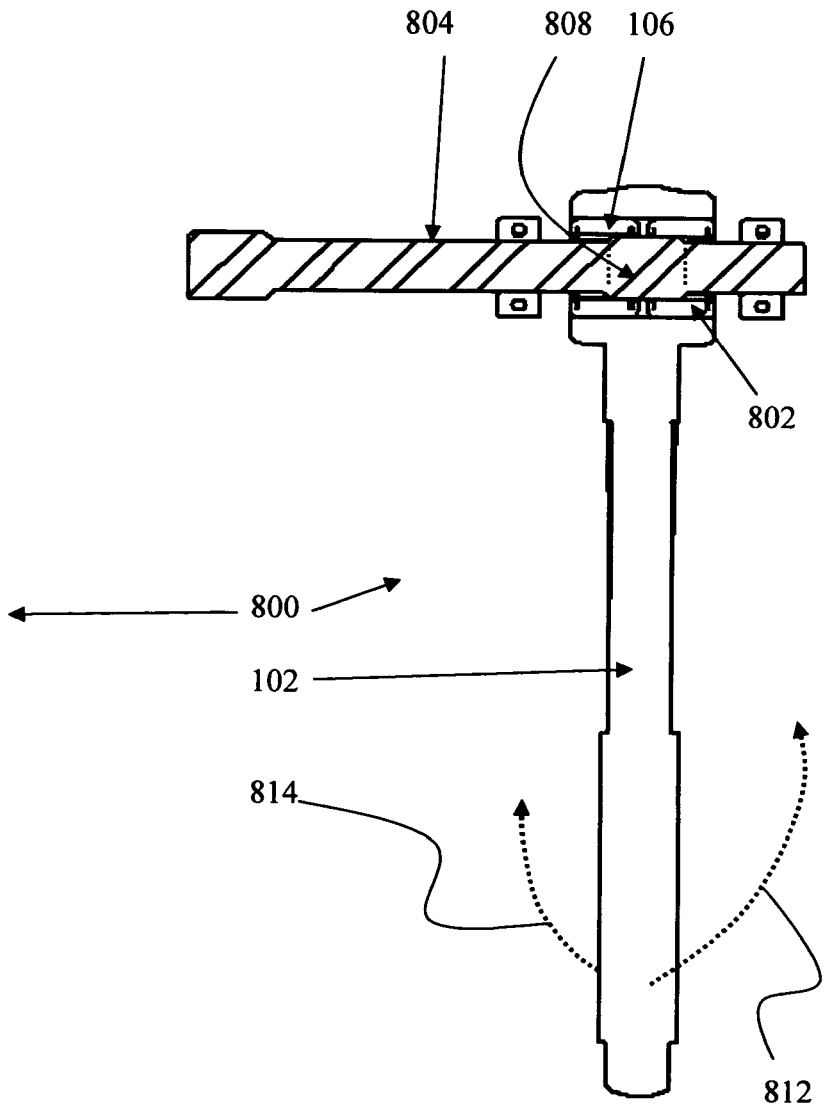
FIG. 11B is a cross-sectional view of a universal stepless wrench according to the present invention, taken from line XI—XI of FIG. 11A.

FIG. 11A illustrates a front perspective view of the universal stepless wrench 800 of FIG. 8. As illustrated in FIG. 11B, the raised section 808 of the slideable shaft 804 is engaged with both the first rotatable 106 and the second rotatable 802. In this position, the tool handle 102 may not rotate freely around the slideable shaft 804 in either the first direction 812 or the second direction 814, but rather engages with and locks against the slideable shaft 804 when turned in either direction.

Figure 12:
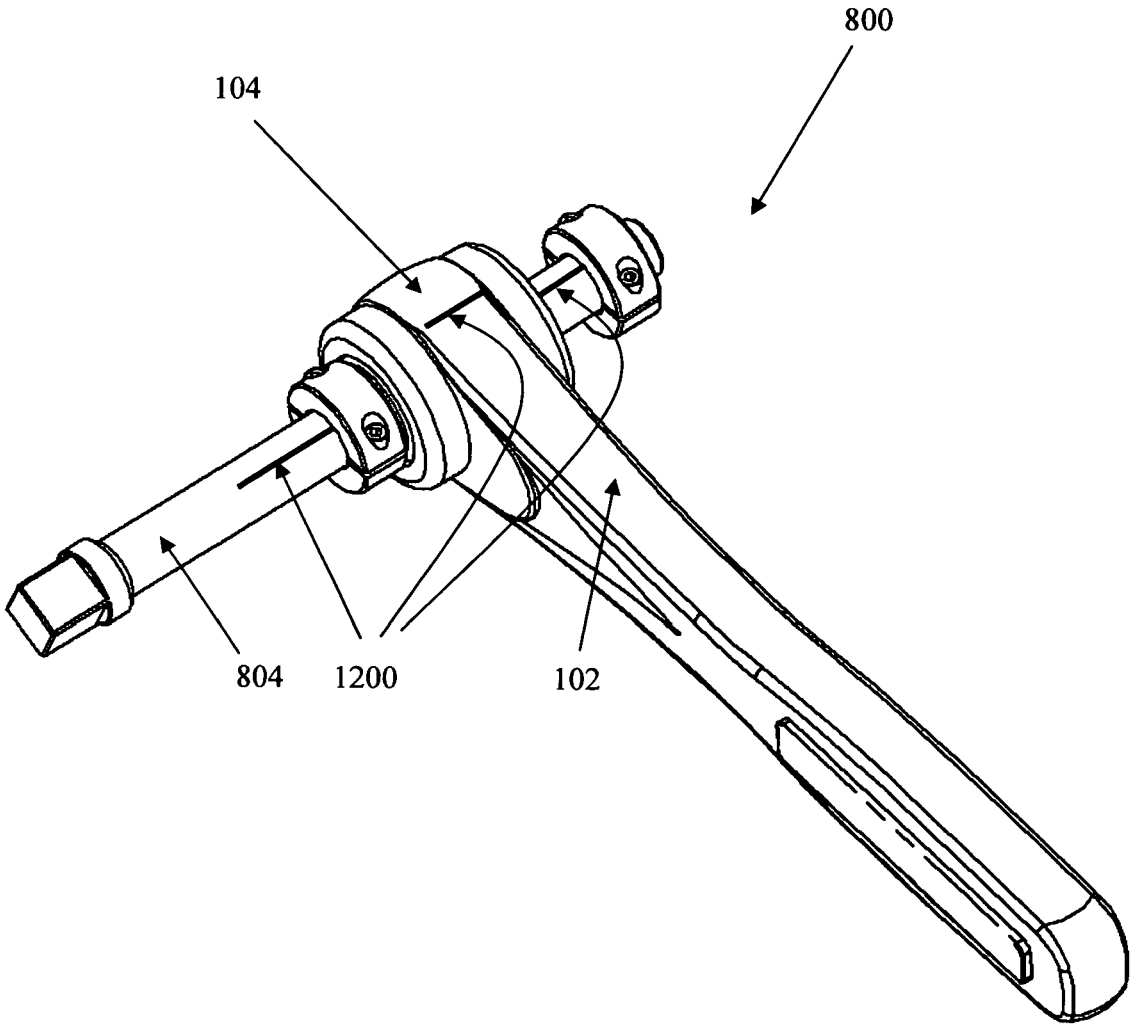
FIG. 12 is a side perspective view of the universal stepless wrench of FIG. 8.

FIG. 12 illustrates a side perspective view of an assembled universal stepless wrench 800. As illustrated, the first and second rotatables are encased in the rotatable receiving portion 104.

Additionally, both the slideable shaft 804 and the tool handle 102 include angle markings 1200. The angle markings 1200 allow a user to determine to what degree or angle the slideable shaft 804 has been turned. The angle markings 1200 may located at any suitable location to allow a user to compare the angle markings 1200 on the slideable shaft 804 with the angle markings 1200 on the tool handle 102, non-limiting examples of which include being along the sides of the slideable shaft 804 and along the top and sides of the tool handle 102. For example, the slideable shaft 804 may simply have a line marked thereon, that can be compared to a plurality of markings on the tool handle 102, where the markings on the tool handle include an angle degree corresponding to each marking.

What is claimed is:

1. A universal stepless wrench, comprising:

a tool handle having a rotatable receiving-portion;

a first rotatable encased in the rotatable receiving-portion of the tool handle, the first rotatable allowing the tool handle to rotate freely around an inserted slideable shaft in one direction, but to engage with and lock against the inserted slideable shaft when turned in an opposite direction;

a slideable shaft for inserting into the first rotatable, whereby when the slideable shaft is inserted, the first rotatable allows the tool handle to freely rotate around the slideable shaft in one direction, but to engage with and lock against the slideable shaft when turned in an opposite direction, thereby allowing for rotation of the slideable shaft in a desired direction; and wherein the universal stepless wrench further comprises an annular elastic cap having a central opening and covering a lip portion of the first rotatable, where the slideable shaft is inserted through the annular elastic cap and into the first rotatable.

2. A universal stepless wrench as set forth in claim 1, wherein the slideable shaft is a removable shaft.

3. A universal stepless wrench as set forth in claim 2, wherein the first rotatable comprises:

a hollow cylinder with a plurality of recesses spaced around a circumference of the hollow cylinder;

rotary elements included in each recess of the plurality of recesses; and a bearing wall encasing both the hollow cylinder and the rotary elements.

4. A universal stepless wrench as set forth in claim 3, wherein the plurality of recesses are wedge-shaped recesses.

5. A universal stepless wrench as set forth in claim 4, wherein the rotary elements are drawn-cup needle roller clutch bearings.

6. A universal stepless wrench as set forth in claim 5, further comprising an axial protector on at least one end of the first rotatable.

7. A universal stepless wrench as set forth in claim 6, wherein the axial protector is selected from a group consisting of bushings and bearings.

8. A universal stepless wrench as set forth in claim 7, wherein the slideable shaft includes at least one notch.

9. A universal stepless wrench as set forth in claim 8, wherein the at least one notch runs around a circumference of, perpendicularly to a length of, the slideable shaft, whereby when the slideable shaft is inserted through the annular elastic cap, the annular elastic cap engages with the notch in order to adjustably hold the slideable shaft in place.

10. A universal stepless wrench as set forth in claim 9, wherein the slideable shaft has both a socket-receiving end and a bit-receiving end.

11. A universal stepless wrench as set forth in claim 10, wherein the slideable shaft and the tool handle both include angle markings, allowing a user to determine to what angle the slideable shaft has been turned.

12. A universal stepless wrench as set forth in claim 11, wherein the tool handle is configured to operate perpendicularly to an inserted slideable shaft.

13. A universal stepless wrench as set forth in claim 11, wherein the tool handle is configured to operate parallel to an inserted slideable shaft.

14. A universal stepless wrench, comprising:

a tool handle having a rotatable receiving-portion;

a first rotatable encased in the rotatable receiving-portion of the tool handle, the first rotatable allowing the tool handle to rotate freely around an inserted slideable shaft in one direction, but to engage with and lock against the inserted slideable shaft when turned in an opposite direction;

a slideable shaft for inserting into the first rotatable, whereby when the slideable shaft is inserted, the first rotatable allows the tool handle to freely rotate around the slideable shaft in one direction, but to engage with and lock against the slideable shaft when turned in an opposite direction, thereby allowing for rotation of the slideable shaft in a desired direction;

wherein the universal stepless wrench further comprises a second rotatable encased in the rotatable receiving-portion of the tool handle, where the second rotatable is positioned opposite the first rotatable such that the first rotatable allows for rotation in a first direction, while the second rotatable allows for rotation in a second direction;

wherein the slideable shaft further comprises a raised section, where the raised section engages with at least one of the first and second rotatable, wherein each of the first rotatable and the second rotatable comprise:

a hollow cylinder with a plurality of recesses spaced around a circumference of the hollow cylinder;

rotary elements included in each recess in the plurality of recesses; and a bearing wall encasing both the hollow cylinder and the rotary elements;

wherein the plurality of recesses are wedge-shaped recesses; and wherein the slideable shaft and the tool handle both include angle markings, allowing a user to determine to what angle the slideable shaft has been turned.

15. A universal stepless wrench as set forth in claim 14, wherein the rotary elements are drawn-cup needle roller clutch bearings.

16. A universal stepless wrench as set forth in claim 15, further comprising an axial protector on at least one end of the first rotatable and the second rotatable.

17. A universal stepless wrench as set forth in claim 16, wherein the axial protector is selected from a group consisting of bushings and bearings.

18. A universal stepless wrench, comprising:

a tool handle having a rotatable receiving-portion;

a first rotatable encased in the rotatable receiving-portion of the tool handle, the first rotatable allowing the tool handle to rotate freely around an inserted slideable shaft in one direction, but to engage with and lock against the inserted slideable shaft when turned in an opposite direction;

a slideable shaft for inserting into the first rotatable, whereby when the slideable shaft is inserted, the first rotatable allows the tool handle to freely rotate around the slideable shaft in one direction, but to engage with and lock against the slideable shaft when turned in an opposite direction, thereby allowing for rotation of the slideable shaft in a desired direction; and further comprising an axial protector on at least one end of the first rotatable, thereby helping with an axial load; and wherein the axial protector is selected from a group consisting of bushings and bearings.

19. A universal stepless wrench, comprising:

a tool handle having a rotatable receiving-portion;

a first rotatable encased in the rotatable receiving-portion of the tool handle, the first rotatable allowing the tool handle to rotate freely around an inserted slideable shaft in one direction, but to engage with and lock against the inserted slideable shaft when turned in an opposite direction;

a slideable shaft for inserting into the first rotatable, whereby when the slideable shaft is inserted, the first rotatable allows the tool handle to freely rotate around the slideable shaft in one direction, but to engage with and lock against the slideable shaft when turned in an opposite direction, thereby allowing for rotation of the slideable shaft in a desired direction; and wherein the slideable shaft includes a notch.

20. A universal stepless wrench as set forth in claim 19, wherein the notch runs around a circumference of, perpendicularly to a length of, the slideable shaft, whereby when the slideable shaft is inserted through the annular elastic cap, the annular elastic cap engages with the notch in order to adjustably hold the shaft in place.

21. A universal stepless wrench, comprising:

a tool handle having a rotatable receiving-portion;

a first rotatable encased in the rotatable receiving-portion of the tool handle, the first rotatable allowing the tool handle to rotate freely around an inserted slideable shaft in one direction, but to engage with and lock against the inserted slideable shaft when turned in an opposite direction;

a slideable shaft for inserting into the first rotatable, whereby when the slideable shaft is inserted, the first rotatable allows the tool handle to freely rotate around the slideable shaft in one direction, but to engage with and lock against the slideable shaft when turned in an opposite direction, thereby allowing for rotation of the slideable shaft in a desired direction; and wherein the slideable shaft has both a socket-receiving end and a bit-receiving end.

22. A universal stepless wrench, comprising:

a tool handle having a rotatable receiving-portion;

a first rotatable encased in the rotatable receiving-portion of the tool handle, the first rotatable allowing the tool handle to rotate freely around an inserted slideable shaft in one direction, but to engage with and lock against the inserted slideable shaft when turned in an opposite direction;

a slideable shaft for inserting into the first rotatable, whereby when the slideable shaft is inserted, the first rotatable allows the tool handle to freely rotate around the slideable shaft in one direction, but to engage with and lock against the slideable shaft when turned in an opposite direction, thereby allowing for rotation of the slideable shaft in a desired direction; and wherein the slideable shaft and the tool handle both include angle markings, allowing a user to determine to what angle the slideable shaft has been turned.

23. A method for forming a universal stepless wrench, comprising acts of:

forming a tool handle having a rotatable receiving-portion;

encasing a first rotatable in the rotatable receiving-portion of the tool handle, the first rotatable allowing the tool handle to rotate freely around an inserted slideable shaft in one direction, but to engage with and lock against the inserted slideable shaft when turned in an opposite direction;

forming a slideable shaft configured to be insertable into the first rotatable, whereby when the slideable shaft is inserted, the first rotatable allows the tool handle to freely rotate around the slideable shaft in one direction, but to engage with and lock against the slideable shaft when turned in an opposite direction, thereby allowing for rotation of the slideable shaft in a desired direction; and further comprising an act of attaching an annular elastic cap with the tool handle, the annular elastic cap having a central opening and covering a lip portion of the first rotatable, where the slideable shaft is insertable through the annular elastic cap and into the first rotatable.

24. A method for forming a universal stepless wrench, comprising acts of:

forming a tool handle having a rotatable receiving-portion;

encasing a first rotatable in the rotatable receiving-portion of the tool handle, the first rotatable allowing the tool handle to rotate freely around an inserted slideable shaft in one direction, but to engage with and lock against the inserted slideable shaft when turned in an opposite direction;

forming a slideable shaft configured to be insertable into the first rotatable, whereby when the slideable shaft is inserted, the first rotatable allows the tool handle to freely rotate around the slideable shaft in one direction, but to engage with and lock against the slideable shaft when turned in an opposite direction, thereby allowing for rotation of the slideable shaft in a desired direction; and further comprising an act of attaching an axial protector with at least one end of the first rotatable.

25. A method for forming a universal stepless wrench as set forth in claim 24, wherein in the act of attaching the axial protector, the axial protector is selected from a group consisting of bushings and bearings.

26. A method for forming a universal stepless wrench, comprising acts of:

forming a tool handle having a rotatable receiving-portion;

encasing a first rotatable in the rotatable receiving-portion of the tool handle, the first rotatable allowing the tool handle to rotate freely around an inserted slideable shaft in one direction, but to engage with and lock against the inserted slideable shaft when turned in an opposite direction;

forming a slideable shaft configured to be insertable into the first rotatable, whereby when the slideable shaft is inserted, the first rotatable allows the tool handle to freely rotate around the slideable shaft in one direction, but to engage with and lock against the slideable shaft when turned in an opposite direction, thereby allowing for rotation of the slideable shaft in a desired direction; and further comprising an act of forming at least one notch in the slideable shaft.

27. A method for forming a universal stepless wrench as set forth in claim 26, wherein in the act of forming the at least one notch, the at least one notch runs around a circumference of, perpendicularly to a length of, the slideable shaft, whereby when the slideable shaft is inserted through the annular elastic cap, the annular elastic cap engages with the notch in order to adjustably hold the slideable shaft in place.

28. A method for forming a universal stepless wrench, comprising acts of:

forming a tool handle having a rotatable receiving-portion;

encasing a first rotatable in the rotatable receiving-portion of the tool handle, the first rotatable allowing the tool handle to rotate freely around an inserted slideable shaft in one direction, but to engage with and lock against the inserted slideable shaft when turned in an opposite direction;

forming a slideable shaft configured to be insertable into the first rotatable, whereby when the slideable shaft is inserted, the first rotatable allows the tool handle to freely rotate around the slideable shaft in one direction, but to engage with and lock against the slideable shaft when turned in an opposite direction, thereby allowing for rotation of the slideable shaft in a desired direction; and wherein the act of forming the slideable shaft further comprises an act of forming both a socket-receiving end and a bit-receiving end on the slideable shaft.

29. A method for forming a universal stepless wrench, comprising acts of:

forming a tool handle having a rotatable receiving-portion;

encasing a first rotatable in the rotatable receiving-portion of the tool handle, the first rotatable allowing the tool handle to rotate freely around an inserted slideable shaft in one direction, but to engage with and lock against the inserted slideable shaft when turned in an opposite direction;

forming a slideable shaft configured to be insertable into the first rotatable, whereby when the slideable shaft is inserted, the first rotatable allows the tool handle to freely rotate around the slideable shaft in one direction, but to engage with and lock against the slideable shaft when turned in an opposite direction, thereby allowing for rotation of the slideable shaft in a desired direction;

further comprising an act of encasing a second rotatable in the rotatable-receiving portion of the tool handle, where the second rotatable is positioned opposite the first rotatable such that the first rotatable allows for rotation in a first direction, while the second rotatable allows for rotation in a second direction; and further comprising an act of attaching an axial protector on at least one end of the first rotatable and the second rotatable.

30. A method for forming a universal stepless wrench as set forth in claim 29, wherein in the act of attaching an axial protector, the axial protector is selected from a group consisting of bushings and bearings.

* * * * *